US005278529A

United States Patent [19]

Willems

[11] Patent Number: 5,278,529

[45] Date of Patent: Jan. 11, 1994

[54] BROADBAND MICROSTRIP FILTER APPARATUS HAVING INTELEAVED RESONATOR SECTIONS

[75] Inventor: David A. Willems, Salem, Va.

[73] Assignee: ITT Corporation, New York, N.Y.

[21] Appl. No.: 835,767

[22] Filed: Feb. 13, 1992

[51] Int. Cl.[5] ..... H01P 1/203

[52] U.S. Cl. ..... 333/204; 333/110; 333/116

[58] Field of Search ..... 333/116, 110, 204, 111

[56] References Cited

U.S. PATENT DOCUMENTS

| | | | |
|---|---|---|---|
| 4,001,730 | 1/1977 | Spinner | 333/111 |
| 4,482,873 | 11/1984 | Nyhus | 333/238 X |
| 4,532,484 | 7/1985 | Tajima | 333/238 X |
| 4,967,171 | 10/1990 | Ban et al. | 333/116 |

*Primary Examiner*—Benny Lee

*Attorney, Agent, or Firm*—Arthur L. Plevy; Patrick M. Hogan

[57] ABSTRACT

A broadband microstrip filter structure employs a first transmission line which basically consists of a series of capacitor plates which extend between a dielectric layer from a first location to a second location and each of the series of plates are connected together with a top plate on the top surface of the dielectric and a bottom plate located a given distance beneath the dielectric layer. A second transmission line alternates between the top and bottom layers of the dielectric and consists of a second series of capacitive plates whereby each capacitor is connected to an adjacent capacitor with the top plate of the first connecting to the bottom plate of the second and the bottom plate of the first connecting to the top plate of the second and so on. This pattern is repeated so that the conductor path alternates from the top to the bottom plate. Various capacitors are selected to provide predetermined length resonators while various other capacitors are provided to provide coupling sections. In this configuration each of the above-noted lines provide switching from the top to the bottom so that each conductor averages the same distance from the ground plane insuring identical impedances in each line. The structure allows tight coupling and enables the even and odd mode phase velocity differences to be compensated for due to the fact that the odd mode travels between the two conductors and the even mode travels between the conductor and the ground plane. In this manner the odd mode travels faster but further, thus the even mode and the odd mode move down the structure in synchronism.

18 Claims, 3 Drawing Sheets

BROADBAND MICROSTRIP FILTER APPARATUS HAVING INTELEAVED RESONATOR SECTIONS

FIELD OF THE INVENTION

This invention relates to microwave filter apparatus and more particularly to a broadband filter which employs microstrip technology.

BACKGROUND OF THE INVENTION

The microwave frequency is in that portion of the electromagnetic spectrum where the wavelength is of the same order of magnitude as the characteristic size of the circuit carrying the electrical energies. The frequencies most often considered to be in this category lie between approximately 1 and 200 GHz. Microwave circuits usually contain distributed circuit elements. Circuits used at lower frequencies usually have lumped elements while circuits used at higher frequencies use optical techniques. As one can ascertain, the microwave frequency range has been applied widely in communications systems, radar systems and in various other applications. High performance filter are an integral part of microwave systems.

Parallel coupled microstrip filters are extensively used as band pass filters in such systems due to their small size and their relatively easy fabrication. Such filters can be designed with reasonable accuracy using the design information obtainable in the literature. Microstrip (MS) is used in circuits where discrete devices are bonded to the circuit, where easy access is needed for tuning, or a compact design is needed.

Since the electromagnetic fields lie partly in air and partly in the dielectric, obtaining solutions for the characteristic impedances and effective dielectric constant in MS is more complicated than it is for stripline. Furthermore, microstrip is only approximately a TEM transmission line, but unless the circuit to be used is for very broad bandwidth applications or it is physically many wavelengths long, dispersion will not be a problem. Thus the TEM approximation gives useful results in the design of microstrip circuits. Since microstrip is a non-homogenous medium, the even and odd mode phase velocities for a couple or pair of microstrip lines are unequal. The difference in the phase velocities results in the filter having an asymmetric passband response, deteriorates the upper stopband performance and moves the second passband (which is about twice the center frequency) towards the center frequency.

Certain bandpass filters which have been built on microstrip are referred to as parallel edge coupled filter devices. The prior art is replete with such devices. Reference is made to an article entitled "Broadbanding Microstrip Filters Using Capacitive Compensation" by Inder J. Bahl of ITT Gallium Arsenide Technology Center and published in *Applied Microwave*, August-/September 1989, pp. 70-76. The paper describes a capacitor compensated parallel coupled microstrip filter design with a symmetrical passband and second passband above twice the filter center frequency. Each resonator, in a typical parallel edge coupled device, is a half wavelength long. The first quarter wavelength coupled to the previous resonator and the second quarter wavelength coupled to the following resonator. If this type of filter is realized in a TEM structure it could have an infinite rejection at twice the center frequency and a second passband at three times the center frequency which allows the passband to have functional bandwidths of 40% to 60%. However, as indicated above, microstrip is not a true TEM structure and the rejection at twice the center frequency is relatively poor because the coupled sections of the resonators have even and odd mode phase velocities that travel at different speeds. The even mode travels in the dielectric and the odd mode (the coupling fields between the conductors) travels in the air and dielectric which causes the odd mode to travel faster than the even mode.

Another reason why such filters are not used for broad bandwidths is because they require tight coupling and therefore the physical separation between resonators is extremely small and the dimensions are so critical that such filters have been relatively impractical to construct and manufacture.

As indicated in many prior art designs, the poor stopband rejection forces the microwave designer to employ a lowpass filter preceding the bandpass filter in many systems. The second passband of a bandpass filter, at twice the center frequency, also results in poor second harmonic suppression when used as output filters for oscillators and amplifiers. To overcome this problem bandpass filters using parallel coupled stepped impedance resonators have been implemented. See an article entitled "Bandpass Filters Using Parallel Coupled Strip Line Step Impedance Resonators" published in the *IEEE Transactions on Microwave Theory and Techniques*, Vol. NTT-28, No. 12, December 1980 by M. Makimoto and S. Yamashita, pp. 1413-1417. This article gives approximate design formulas for bandpass filters using parallel coupled stripline stepped impedance resonators (SIR). These are not microstrip devices but are stripline devices.

The prior art was also aware of techniques used to slow down the odd mode velocity in microstrip coupled line filters. See an article entitled "Improved Performance Parallel Coupled Microstrip Filters" by M. R. Moazzam, et al., published in *Microwave Journal*, November 1991, pp. 128-135. This article discusses techniques which are employed to improve the stopband performance of the microstrip parallel coupled line filters. The phase velocities of the two modes may be equalized or a longer path for odd mode energy may be provided; the odd mode phase velocity is higher than the even mode phase velocity. Some of the methods used by the prior art to improve stopband performance include over coupling the resonators, suspending the substrate, using parallel coupled step impedance resonators and using capacitors at the end of coupled sections. As indicated in the article, such techniques increase the cost of the original filter and are difficult to implement. The article describes a planar technique for phase velocity compensation whereby the odd mode length is extended by introducing wiggle to the coupled lines. The technique does not add cost to the system and employs wiggly lines to provide compensation of phase velocity difference in parallel coupled microstrip lines.

In view of the above, it is an object of the present invention to provide an improved microstrip filter apparatus eliminating many prior art problems.

It is a further object of the present invention to provide a microstrip structure that allows tight coupling and solves the even and odd mode phase velocity difference problem to enable the construction of broadband filters.

DETAILED DESRIPTION OF THE FIGURES

Figure 1:
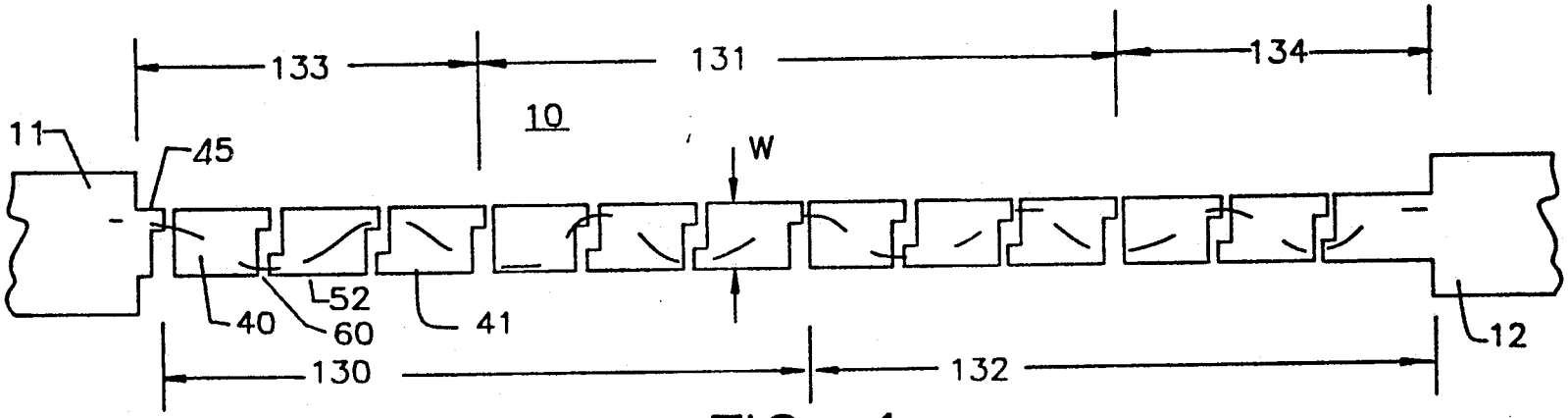
FIG. 1 is a top plan view of a transmission line microstrip filter according to this invention.
Figure 2:
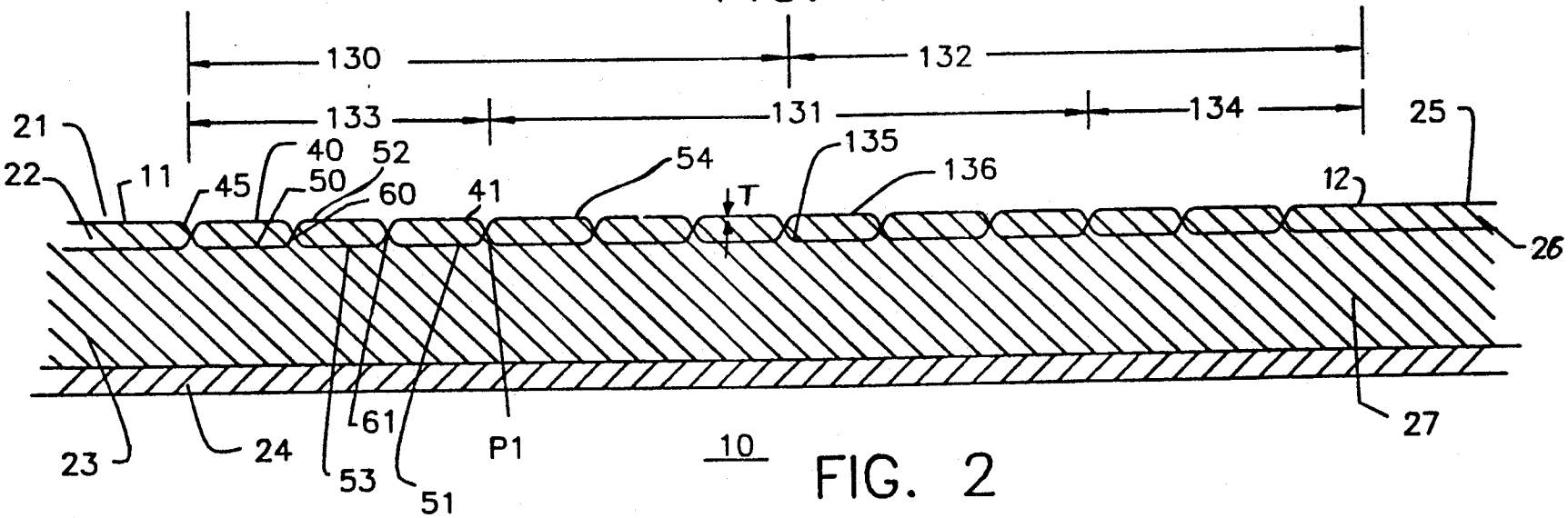
FIG. 2 is a side view of the broadband microstrip filter apparatus of FIG. 1.
Figure 2A:
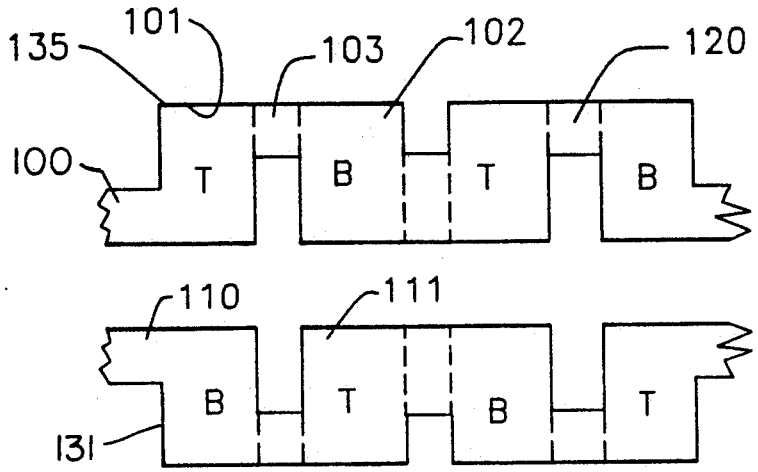
FIG. 2*a* is a top partial view of a first and second line configuration employed in the filter of FIG. 1.
Figure 3:
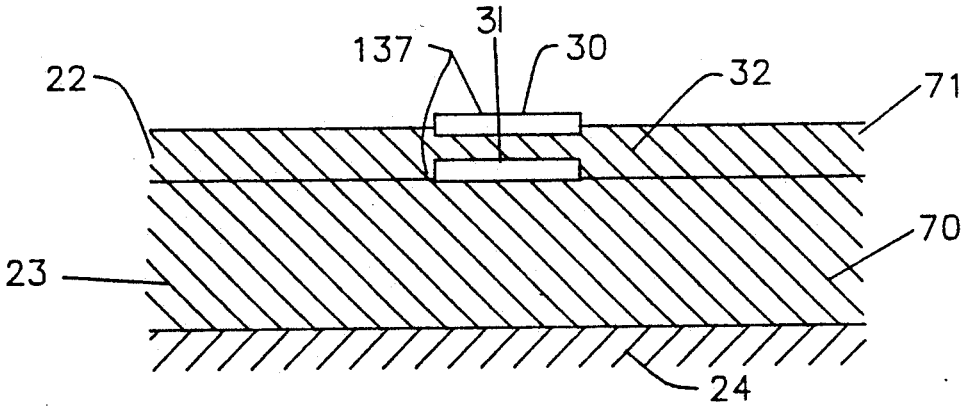
FIG. 3 is a cross-sectional view of the broadband filter apparatus shown in FIGS. 1 and 2.

FIG. 1 depicts a top view of a broadband microstrip filter according to this invention. FIG. 2 depicts a side view of the microstrip filter depicted in FIG. 1, and FIG. 3 depicts a cross-sectional view of the microstrip filter. FIG. 2*a* is a top view showing a first line separated from a second line which are employed to fabricate the filter of FIG. 1.

Referring to FIG. 1 there is shown a top view of the filter. The filter, as indicated, is of a microstrip configuration which essentially consists of a semi-insulating semiconductor or a dielectric (not shown herein) having positioned on a top surface of the semiconductor an alternating conductor pattern. Basically a microstrip configuration consists of strip conductor of width w and thickness T on a dielectric (GaAs) substrate with the backside metalized to form a ground plane. Apart from gallium arsenide substrates one can employ alumina substrates and other material. Microstrip (MS) is the most popular transmission line configuration for monolithic IC applications due to the following.

1. Passive and active elements are easily inserted in series with the MS strip conductor on the surface of the chip.

2. The metalized ground plane on the back of the substrate can be used both as a mounting surface and the heat sink for heat generated by the active devices on the substrate.

3. A large body of theoretical and experimental data exists for the microstrip configuration.

4. The losses and dispersions are low while the output impedance range is moderate.

A disadvantage of microstrip is due to its non-coplanar geometry which makes it difficult to connect elements in shunt to ground. Microstrip techniques are well known and have been widely utilized in both the technology involving metal-insulator-metal (MIM) capacitors on monolithic microwave integrated circuits (MMICs). The shown bandpass filter 10 is depicted in top view of FIG. 1 and has associated therewith an input transmission line, section 11. The input 11 transmission line is basically a microstrip line and as shown in FIG. 2 consists of a metalized conductor 21 separated by a dielectric layer 22 from a dielectric 23 which is positioned on the ground plane 24.

As shown in FIG. 1, the filter 10 is implemented in three sections which constitute a first resonator section 130, a second resonator section 131 and a third resonator 132. The input for the first resonator 130 is coupled to the input transmission line 11 and is coupled to the second resonator 131 via input coupling 133, as will be explained. The output from the third resonator 132 is coupled to the output transmission line 12 and is coupled to the second resonator 131 via output coupling 134. The second resonator is coupled both to the first resonator 130 and the third resonator 132 to provide a transition therebetween. The third resonator 132 is coupled to an output transmission line 12 which again is of a microstrip configuration and, as shown in FIG. 2 consists of an output conductor 25 which is positioned on the dielectric layer 26, which dielectric layer 26 is in turn positioned on dielectric area 27, and dielectric area 27 is positioned or mounted on the ground plane 24.

The dielectric layers 22 and 23 may be a single dielectric layer but preferably two layers are used with one layer as 22 deposited or formed on layer 23. Essentially, referring to FIGS. 1, 2 and 2*a*, the device basically, as shown in FIG. 1 consists of a series of capacitor plates of width w and thickness t namely 40, 52 and 41 which extend from the input transmission line 11 to the output transmission line 12. A first plurality of plates, as shown, are positioned on the top surface of the dielectric 22 which is further shown in FIG. 2 where the plates, as 40, 52, 41 and 54 are alternately shown by the solid and dashed lines. The reason for the solid and dashed lines in FIG. 2 is to show that the plates are associated with separate lines whereby plates such as 52 and 50 which are respectively a top and a bottom plate, are actually connected together, whereas plates as 40 and 53, which are also a top and bottom plate, are also connected together. Located beneath each top plate and separated by a thin layer of dielectric 22 is a bottom plate. Each top plate, as 40 and 52 and 41 is associated with a bottom plate to form a given length transmission line. Thus, as seen in FIG. 2 top plate 40 is associated with bottom plate 50, top plate 52 is associated with bottom plate 53 and so on. Also, the bottom plate 50 is connected to the top plate 52 with the top plate 52 connected with the bottom plate 51. These connections are made through the vias as shown in FIG. 1 as 61, 62, 60 and so on. In this manner, capacitively coupled transmission lines of any given length can be connected together or appropriately coupled. It is to be noted that as to FIG. 2 and subsequent figures, reference designators which are shown in the figures but not specifically delineated in the specification refer to the same structural element for which such reference designator was applied in a prior figure.

FIG. 2*a* shows a section of a first line 135 which consists of a top plate 101 formed on the top surface of the dielectric layer 22 connected to a bottom plate 102 located beneath one top surface of the dielectric layer 22. The top plate 101 is connected to the bottom plate 102 by means of a via 103. As shown in FIG. 2, via 60 connects bottom plate 50 to top plate 52 and via 61 connects top plate 52 to bottom plate 51. In FIG. 2*a*, the first line 135 shown is a section and consists of a top plate (T) connected to a bottom plate (B) connected to another top plate (T) which is connected to another bottom plate (B).

On the other hand there is a second transmission line section 136 which is also shown in FIG. 2A where a bottom plate 110 is connected to a top plate 111 which is connected to another bottom plate through respective vias. As one can see, the first line 135 is a mirror image of the second line 136. Essentially, as one can see from FIGS. 1 and 2, the first line 135 alternates from top to bottom while the second line 136 alternates from bottom to top with the top plate 40 of the first line 135 for example associated with the bottom plate 50 of the bottom line 136, and with the top plate 52 of the bottom line or second line 136 associated with the bottom plate 53 of the first line 135 and so on. Thus, by selecting a number of capacitors each of which include a top and a bottom plate one can form a given line length. Then one can form a first resonator as shown in FIG. 1, a second resonator 131, a third resonator 132, as well as an input coupling section 133 an output coupling section 134. The fabrication of such a line is relatively simple as one would create a channel on the surface of dielectric layer 23 than form all the bottom plates. Then another mark would be used, for example, to form the top plates and the via sections to connect the top plates to the bottom plates after a layer of dielectric 22 has been grown over all the bottom plates. There are many ways of fabricating the structure depicted in FIG. 1 and FIG. 2. In practice, of course, lines 135 and 136 will be directly positioned on top of one another to offer the configuration shown in FIG. 1. As shown in FIG. 1, the dotted line represents the odd mode path which propagates in the above-noted structure.

The resonator sections 130, 131 and 132 as shown in FIGS. 1 and 2 are all a half wavelength long while the coupling sections, which are the input coupling and output coupling sections, 133 and 134 respectively, are one-quarter wavelength. Basically the input coupling section 133 couples the input transmission line 11 to the first resonator 130 while the second resonator 131 couples the first resonator 130 to the third resonator 132 with the third resonator 132 being coupled to the output transmission line 12 by means of the output coupling section 134, which again as indicated is a quarter of a wavelength at the microwave frequencies being employed.

FIG. 3 shows another cross-sectional configuration of the circuit. As seen in FIG. 3 there is shown a top plate 30 which is coupled to a bottom plate 31 thus forming a capacitor 137. The dielectric layer 33 between the plates acts as a capacitive dielectric and also enables coupling from the conductive plate 30 to the conductive plate 31. The circuit basically operates as follows. Each capacitor is connected to the adjacent capacitor with the top plate of the first capacitor connecting to the bottom plate of the second capacitor and the bottom of the first capacitor connecting to the top plate of the second capacitor. The sequence is repeated so that the conductor path alternates from the top plate to the bottom plate for a predetermined length to form a resonator or a predetermined transmission line section.

Another way of looking at the structure is considering is to be a pair of broad side coupled lines that are twisted from the fabrication standpoint as a long thin capacitor. By switching from the top to the bottom plate each conductor averages the same distance from the ground plane. This assures identical impedances for each transmission line section. In order to further clarify this, reference is again made to FIG. 1 and FIG. 2. As seen, FIG. 2 shows a solid line and a dashed line to indicate the first and second transmission lines 135 and 136 respectively.

Referring to FIG. 1, the input transmission line 11 is coupled to a via 60 which is directed from the top of the substrate through the dielectric to a bottom plate 50, as shown in FIG. 2, for the first capacitor. The top plate 40 is shown in dashed line in FIG. 2 and hence one sees that the bottom plate of the capacitor is formed by the central portion of the trough-like area which has one sloped or inclined via 45 which connects the input transmission line 11 directly to the bottom plate 50 of the first capacitor. The bottom plate 50 is connected to via 60 which again goes through the dielectric 22 at the sloped angle to the top plate 52 of the second capacitor. The bottom plate 53 of the second capacitor is shown in dashed line and is connected to the top plate 40 of the first capacitor via a suitable via. Thus, as seen, the bottom plate 51 of the third capacitor is connected to the top plate 52 of the second capacitor via the via 61. Thus, each top plate of a capacitor is connected to the bottom plate of the next capacitor which is connected to the top plate of the next capacitor and so on via the vias or feedthroughs as 45, 60 and 61 and as shown.

The dashed line configuration represents an opposite transmission line structure as that shown by the solid line in FIG. 2. Each input coupling and output coupling section shown in FIG. 1 and FIG. 2 comprise three capacitors which basically form a quarter wavelength line at the operating center frequency. Each resonator includes six capacitors which essentially operate to form at half wavelength structure at the equivalent frequency.

As seen, the input coupling capacitors which are shown in FIG. 2 include the top plate 40 of the first capacitor with the bottom plate 50, the top plate 52 of the second capacitor with the bottom plate 53, and the top plate 41 of the third capacitor and its bottom plate 51. It is seen now that the bottom plate of the third capacitor is not connected to the top plate 54 of the fourth capacitor at point P1 but is capacitively coupled thereto and there is no via which makes such a connection. In this manner the input coupling section, which consists of three capacitors, also serves as part of the first three capacitors for the first resonator 130 with three capacitors being capacitively coupled to the next three capacitors of the second resonator 131 which also are the last three capacitors of the first resonator. Hence, each input coupling and output coupling device consists of three capacitors of a quarter of a wavelength. The three capacitors which form the input and output coupling also form part of the respective resonators, as for example the first three capacitors of the first resonator 130 and the last three capacitors of the third resonator. The second resonator 131 includes the last three capacitors of the first resonator 130 and the first three capacitors of the third resonator 132.

Referring to FIG. 2*a* there is shown a top plan view of the first line 135 or a top line and a second line 136 or a bottom line. As one can see immediately from FIG. 2*a* the segments of the first line 135 and the second line 136 are mirror images. Essentially the first line 135 begins with a first via 100. Basically the via 100 may be connected to the input transmission line 11 and extends down at an angle as via 45 in FIG. 2 through the dielectric. The via 100 is connected to a top plate at the bottom end which top plate is, for example, square in configuration and of a given area. The top plate at the top end is now connected to another via 103 which via extends again down into the dielectric at an angle such as via 61 of FIG. 2. This is connected to a bottom plate 102. The opposite end of the bottom plate then is connected to a via which again extends up from the dielectric to the top surface of the dielectric to connect to a top plate designated as T. The opposite side of the top plate T then is connected to another bottom plate B and so on. The second line has the configuration shown in FIG. 2*a* and hence adjacent every top plate 101 is a corresponding bottom plate 110. The vias associated with the bottom line also are located on opposite ends of a bottom plate or a top plate and extend down through the dielectric so that they are again connected to a top and bottom plate. Thus, as can be seen from FIG. 2*a* each top plate as 101 has an associated bottom plate as 110 which top plate is associated with the first line and the bottom plate is associated with the second line.

Each plate may be of the same cross sectional area but does not have to be so as long as there is an overlap to form a capacitor. Hence, as will be shown subsequently the first and the second lines, 135 and 136 respectively as shown in FIG. 2*a* can overlap and do not have to be superimposed one on top of the other. As one can see, the connections between the bottom plates and top plates in each line are accommodated by means of the vias which alternate from the bottom to the top of each plate thereby providing a serpentine structure. This is clearly shown in FIG. 1. As seen, in FIG. 2A, a via or connection can be eliminated, such as via 103, thus preventing a connection between one section of a line and another section of a line. The elimination of the via causes a given wavelength of a line to act as a resonator or as a tuned circuit thereby transferring energy from one resonating section to another by capacitive coupling or by other well known coupled transmission line techniques.

It is thus seen, by referring to both FIGS. 1 and 2, that the structure is entirely symmetrical. In this manner, by connecting a top plate to a bottom plate across the dielectric, each conductor averages the same distance from the ground plane insuring identical impedances in each line.

Slowing odd mode velocity is achieved by two different phenomenons. First by using a capacitor-like structure the field tends to be contained in the dielectric between the capacitor plate instead of the air. Secondly, by alternating the conductor or capacitor connections from side to side forces the odd mode to travel in the path described and shown by the dotted line in FIG. 1. Essentially the signal enters the first line via the capacitor plate 50 through the input transmission line 11 on one side and exists via output transmission line 12 (see FIG. 2) which is coupled to the output coupling member on the other side. Because the odd mode travels between the two conductors and the even mode travels between the conductor and the ground plane, the odd mode travels faster but further, thus the even mode and the odd mode move down the structure in synchronism. The odd mode phase velocity can be adjusted by changing the aspect ratio of the various segments which changes the path length. For example, if a 1 mil$\times$1 mil segment is changed to two 1 mil$\times\frac{1}{2}$ mil segments, the path length is more than doubled for the odd mode. The coupling can also be adjusted.

As shown in FIG. 3 for example, there are two dielectric layers, namely the dielectric layer 70, dielectric layer 71 and the ground plane 24. In any event, the thickness of the dielectric layer 71 can be changed to selectively change the width of the dielectric layer between the capacitor plates and thereby changing the coupling between the plates.

Figure 4:
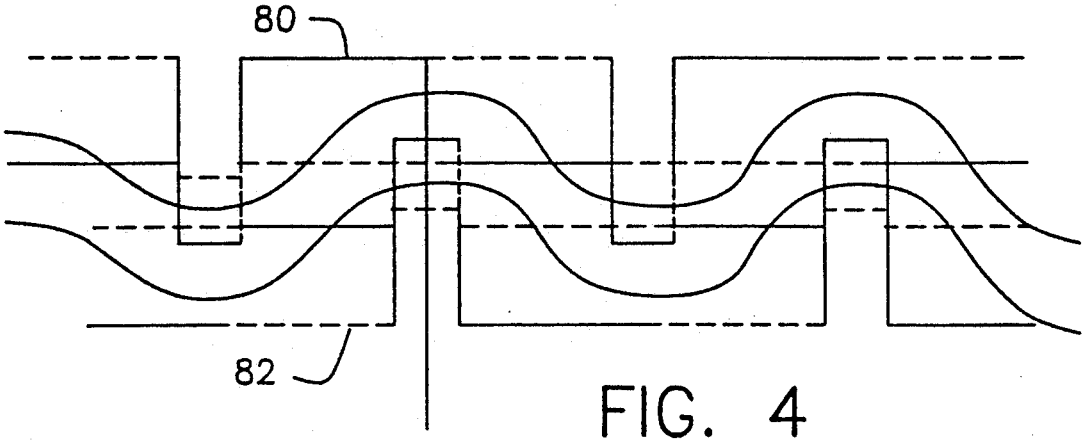
FIG. 4 is a top plan view of a coupled transmission line filter employing offset conductors.

Referring to FIG. 4 there is shown an alternate embodiment of the structure whereby a first transmission capacitor line 80 is coupled to a second line 82 wherein the capacitive plates are offset one from the other to provide coupling between the plates as desired and according to the offset. The sinusoidal patterns in FIG. 4 show the odd mode path between the top and bottom transmission lines. FIG. 4 depicts a top view looking down on a substrate with the visible conductor represented as a solid line and the dotted line representing the conductor which is beneath the dielectric. By offsetting the conductors, one maintains the equalization of the even and odd mode phase velocities and further maintains the exact or equivalent lengths of the transmission line to insure proper impedance value while further enabling the offset conductors to determine the exact coupling between the capacitive plates thereby eliminating the need for a varying thickness dielectric.

Figure 5:
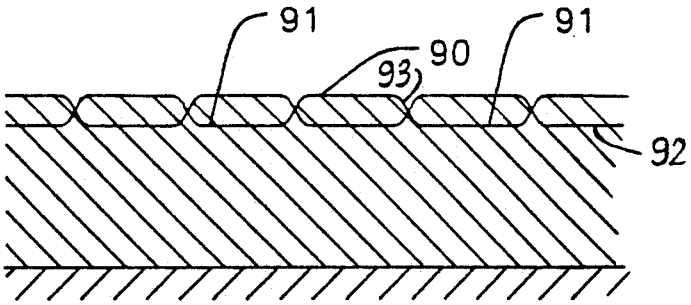
FIG. 5 is a cross-sectional view of a section of a transmission line filter indicating the isolation between non-adjacent resonators.

FIG. 5 shows a section of the filter of FIG. 4 depicting isolation at non-adjacent resonators. With the configuration shown in FIG. 4 or that configuration shown in FIGS. 1, 138 or 2, 139 non-adjacent resonators, such as resonator 1, resonator 2 and resonator 3 140 are shown coupled in FIG. 1 and are further shown as placed in circuit. As indicated above, there are six capacitors for a half wavelength whereby six capacitors constitute a resonator section and three capacitors constitute a coupler section which are of quarter wavelengths. In any event, FIG. 5 shows the coupling and isolation of non-adjacent resonators whereby the top plate for example of a capacitor, as capacitor 90, is not connected to but is coupled to a bottom plate of capacitor 91 by means of dielectric coupling through the substrate rather than by means of a direct connection, as for example, with top plate of capacitor 90 connected to bottom plate 92 of an adjacent capacitor by means of via 93. Thus, one can ascertain how various resonators are isolated.

Figure 6:
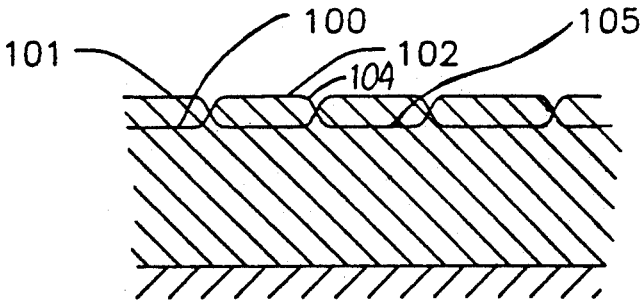
FIG. 6 is a cross-sectional view of a coupled transmission line filter depicting coupling between non-adjacent resonators by permitting the edges of such resonators to be in close proximity.

In a similar manner, referring to FIG. 6, there is shown a section of a filter which depicts the coupling between non-adjacent resonators by allowing the edges to be in close proximity. Thus in FIG. 6 there is shown a space 141 which allows edge coupling of a top plate of a capacitor 142 with a top plate of an adjacent capacitor 143. It is seen that the top plate of capacitor 143 is connected via feed through 144 to a bottom plate of capacitor 145 associated with the third resonator, and so on.

Thus it is seen that the above enables one to provide bandpass filter techniques which are broadband and which essentially have uniform characteristic impedances while further allowing tight coupling and providing an optimum solution between the even and odd mode phase velocity difference problems. In this manner, the transmission lines are coupled transmission lines and operate as filters. Based on microstrip analysis one can provide, for example, three stage or multiple stage filters.

As a practical matter, in such filter design the structure allows for isolation between non-adjacent resonators by terminating and starting resonators in the manner shown in FIG. 5. Chebychev, Butterworth and ladder networks require isolations between non-adjacent resonators and in this manner such isolation can be provided as shown in FIG. 5. However, if an elliptic response is desired it can be effected by allowing the ends of every other resonator to couple, as shown in FIG. 6. This edge coupling enables the coupling of non-adjacent resonators by using the alternating conductor path which forms capacitive conducting between the coupled transmission lines.

What is claimed is:

1. A broadband microstrip filter apparatus, comprising:

a microstrip structure including a ground plane, said ground plane having a dielectric disposed thereon, said dielectric having a top surface;

at least one first conductive line having a first plurality of conductive areas and a second plurality of conductive areas, said first conductive areas being located on said top surface of said dielectric and said second conductive areas being located a given distance beneath said top surface, each separate first and second conductive area having a leading edge and a trailing edge and wherein each of said first conductive areas has a respective trailing edge connected to the leading edge of an adjacent second conductive area, and each of said adjacent second conductive areas has a respective trailing edge connected to the leading edge of a next adjacent first conductive area, all of said first plurality of conductive areas being thereby connected with all of said second plurality of conductive areas to constitute said first conductive line having a square wave pattern;

at least one second conductive line having a third plurality of conductive areas and a fourth plurality of conductive areas, said third conductive areas being located on said top surface of said dielectric and said fourth conductive areas being located said given distance beneath said top surface, each separate third and fourth conductive area having a leading edge and a trailing edge and wherein each of said third conductive areas has a respective trailing edge connected to the leading edge of an adjacent fourth conductive area, and each of said adjacent fourth conductive areas has a respective trailing edge connected to the leading edge of a next adjacent third conductive area, all of said third plurality of conductive areas being thereby connected with all of said fourth plurality of conductive areas to constitute said second conductive line having a square wave pattern, said conductive areas of said first conductive line being disposed relative to said conductive areas of said second conductive line to constitute an interlace pattern, therebetween said third plurality and said second plurality of conductive areas being thereby constituted as a first plurality of capacitors wherein each one of said third conductive areas of said second line constitutes a respective top capacitive plate and a respective one of said second conductive areas of said first line constitutes an associated bottom capacitive plate, said first plurality and said fourth plurality of conductive areas being thereby constituted as a second plurality of capacitors wherein each one of said first conductive areas of said first line constitutes a respective top capacitive plate and a respective one of said fourth conductive areas of said second line constitutes an associated bottom capacitive plate, whereby said first and said second lines are constituted as resonator sections each including a given number of said capacitors with each number of said capacitors of a line length of a fractional wavelength at a frequency of an input microwave signal applied to said filter thereby constituting said microstrip filter apparatus; and wherein said input microwave signal is applied to said microstrip filter apparatus and propagates along said first and said second lines, said microwave signal having an odd mode wave propagating between said first and said second lines and an even mode wave propagating between said first line and said ground plane and between said second line and said ground plane, respectively, and whereupon said even and said odd mode waves travel in synchronism along said first and said second lines of said microstrip filter apparatus.

2. The filter apparatus according to claim 1 wherein said fractional wavelength line length of said resonator sections is a line length of a half wavelength at said frequency of said input microwave signal.

3. The filter apparatus according to claim 2 wherein said means for coupling resonator sections together includes a given number of said capacitors formed by said first and second lines having a length of a quarter wave at said microwave frequency to couple one resonator to another.

4. The filter apparatus according to claim 1 further including an input transmission line having one end coupled to said first line for accepting said input microwave signal applied to said filter.

5. The filter apparatus according to claim 4 wherein said input transmission line is a microstrip line disposed on said microstrip structure.

6. The filter apparatus according to claim 4 further including an output transmission line having one terminal coupled to said first line for providing an output signal for said filter.

7. The filter apparatus according to claim 6 wherein said output transmission line is a microstrip line disposed on said microstrip structure.

8. The filter apparatus according to claim 6 including output coupling means for coupling said output transmission line to said first and second lines.

9. The filter apparatus according to claim 8 wherein said output coupling means includes a quarter wave length capacitive structure.

10. The filter apparatus according to claim 4 including input coupling means for coupling said input transmission line to said first and second lines.

11. The filter apparatus according to claim 10 wherein said input coupling means includes a quarter wave length capacitive structure.

12. The filter apparatus according to claim 1 wherein said microstrip substrate is comprised of GaAs.

13. The filter apparatus according to claim 1 wherein said dielectric between said first and fourth areas is of a given thickness according to the amount of coupling desired.

14. The filter apparatus according to claim 1 wherein said dielectric between said second and third areas is of a given thickness according to the amount of coupling desired.

15. The filter apparatus according to claim 1, wherein said filter apparatus contains a center longitudinal axis, said first and said second lines being offset from one another transversely from said center longitudinal axis, wherein respective ones of said first and said second conductive areas of said first line partially overlap associated ones of said third and said fourth conductive areas of said second line, whereby said top capacitor plates are offset from said bottom capacitor plates by a given amount of overlap to thereby control the amount of coupling between said first and said second lines.

16. The filter apparatus according to claim 1, wherein said first and said fourth conductive areas are disposed relative to one another so that said leading and trailing edges of each of said first conductive areas are essentially coincident respectively with said leading and trailing edges of each of said fourth conductive areas.

17. The filter apparatus according to claim 1, wherein said second and said third conductive areas are disposed relative to one another so that said leading and trailing edges of each of said second conductive areas are essentially coincident respectively with said leading and trailing edges of each of said third conductive areas.

18. The filter apparatus according to claim 1, wherein said first and said fourth and said second and said third conductive areas, respectively, are disposed relative to one another so that said leading and trailing edges of each of said first conductive areas are essentially coincident respectively with said leading and trailing edges of each of said fourth conductive areas and said leading and trailing edges of each of said second conductive areas are essentially coincident respectively with said leading and trailing edges of each of said third conductive areas.

* * * * *